US006894286B2

(12) United States Patent
Derrick et al.

(10) Patent No.: US 6,894,286 B2
(45) Date of Patent: May 17, 2005

(54) ION FOCUSSING AND CONVEYING DEVICE AND A METHOD OF FOCUSSING THE CONVEYING IONS

(75) Inventors: Peter John Derrick, Warks (GB); Alexander William Colburn, Coventry (GB); Anastassios Giannakopulos, Milton Keynes (GB)

(73) Assignee: University of Warwick, Coventry (GB)

( * ) Notice: Subject to any disclaimer, the term of this patent is extended or adjusted under 35 U.S.C. 154(b) by 0 days.

(21) Appl. No.: 10/416,936

(22) PCT Filed: Nov. 23, 2001

(86) PCT No.: PCT/GB01/05174

§ 371 (c)(1),
(2), (4) Date: Sep. 17, 2003

(87) PCT Pub. No.: WO02/43105

PCT Pub. Date: May 30, 2002

(65) Prior Publication Data

US 2004/0046124 A1 Mar. 11, 2004

(30) Foreign Application Priority Data

Nov. 23, 2000 (GB) ..... 0028586

(51) Int. Cl.[7] ..... G21K 1/08; H01J 3/14

(52) U.S. Cl. ..... 250/396 R; 250/292

(58) Field of Search ..... 250/396 R, 282, 250/292, 423 R

(56) References Cited

U.S. PATENT DOCUMENTS

| | | | | |
|---|---|---|---|---|
| 2,798,956 A | | 7/1957 | Lanneau et al. | |
| 5,206,506 A | | 4/1993 | Kirchner | |
| 5,811,820 A | * | 9/1998 | Kirchner et al. | 250/423 R |
| 6,107,628 A | * | 8/2000 | Smith et al. | 250/292 |

* cited by examiner

*Primary Examiner*—Nikita Wells
*Assistant Examiner*—Johnnie L Smith, II
(74) *Attorney, Agent, or Firm*—Wood, Phillips, Katz, Clark & Mortimer

(57) ABSTRACT

An ion focussing and conveying device 10 comprises a plurality of electrodes 12 in series. Means is provided to apply a first alternating voltage waveform to each electrode 12, the phase of the alternating voltage in the first waveform is applied to each electrode 12 in the series being ahead of the phase of the first alternating voltage waveform applied to the preceding electrode 12 in the series by less than 180°, preferably by 90° or less, such that ions are focussed onto an axis of travel and impelled along the series of electrodes 12.

49 Claims, 8 Drawing Sheets

ION FOCUSSING AND CONVEYING DEVICE AND A METHOD OF FOCUSSING THE CONVEYING IONS

The invention relates to an ion focussing and conveying device and to a method of focussing and conveying ions.

Mass spectrometers include a source of ions. One technique to obtain ions is electrospray ionisation (ESI) which is an ionisation method which operates at atmospheric pressure. A solution of analyte molecules is sprayed from the tip of a needle held at high potential producing an aerosol of charged droplets. Bulk transfer properties carry the droplets towards and through an aperture (sometimes a capillary tube) into a low pressure region of the ion source where the pressure is usually between 0.1 mbar and 10 mbar. A second aperture (sometimes a conical skimmer) allows a portion of the expanding jet from the first aperture to pass into a lower pressure region and eventually into the mass analyser. The apertures form conductance restrictions between each vacuum stage necessary for the differential pumping system to operate efficiently. During the passage from atmospheric pressure to the low pressure region within a mass analyser, evaporation of the solvent in the droplet occurs and finally molecule ions arc produced.

Current ESI source designs exhibit poor transmission efficiency due to the considerable loss of charged entities to parts surrounding the various apertures. Experimental measurements have shown that with some sources less than 1 part in $10^3$ of the available current passes through the first aperture and less than 1 part in $10^2$ of that passes through the second apertures Overall, less than 1 part in $10^5$ of the electrospray needle current is typically available as ion current into the mass spectrometer. In order to improve transmission efficiency, a mechanism of focusing the charged entities into the apertures is required. Conventional electrostatic optics techniques, which would be used in high vacuum, do not work in these higher pressure regions due to the large umber of collisions with surrounding gas molecules. Electrostatic optics techniques generally require the energy of transmitted entities to be conserved during their passage through the optical system.

According to one aspect of the invention there is provided an ion focussing and conveying device comprising a plurality of electrodes in series, and means to apply at least one alternating voltage waveform to each electrode. The phase of the alternating voltage in the or a first waveform applied to each electrode in the series being ahead of the phase of the or the first alternating voltage applied to the preceding electrode in the series by less than 180° such that ions are focussed onto an axis of travel and impelled along the series of electrodes.

The trapping and focusing action of this device comes from a development of the "Paul effect". The Paul effect itself is shown where apertured electrodes are arranged in series. An alternating radio-frequency (RF) voltage is applied to alternate electrodes of the series and an alternating voltage in anti-phase to the first is applied to the other electrodes in the series so as to produce an alternating field with a field-free region at its centre between the electrodes. This effect produces focusing of charged entities trapping them in a field-force region along a central axis. In the invention, the voltages applied to adjacent electrodes in the series are systematically deviated from the anti-phase condition to result in a field which pulls the ions through the device.

The principle of operation of the device is thus to produce an alternating electric field or combinations of fields, which have the properties of focusing, collimating, trapping and transmitting charged entities entering the device and reducing the kinetic energies of the entities to a common low value. The entities may have a large spread of mass, energy and position on entering the device. The mechanism of operation is the application of multiple-voltage waveforms to a repetitive series of electrodes where the relative phases and shapes of the waveforms are tailored to produce the desired alternating electric field.

In the case of an ESI source of a mass spectrometer, this means that rather than obtaining less than 1 part in $10^5$ of the electrospray needle current as ion current into the mass analyser, a much higher proportion of the ions produced can be supplied into the mass analyser, due to the focussing, collimation and transmission of the ions.

The phase-difference between adjacent electrodes may each be set at any suitable level, and preferably there is a common phase-difference between all adjacent electrodes. The common phase-difference is preferably 360°/n where n is a natural number greater than two, and preferably greater than three, as this leads to a smoother transmission of the ions The means to apply alternating voltages to the electrodes may apply voltages in any suitable waveform and in one preferred embodiment the means to apply alternating voltages applies alternating voltages with a sinusoidal waveform to the electrodes. Triangular (i.e. saw tooth) and square waveforms can also be used.

The frequency of the or the first applied alternating voltage may be at any suitable desired level, but preferably is less than 100 kHz.

The frequency of the or the first applied alternating voltage may be altered in use and preferably is swept, for example, over a range of at least 100 kHz. This flattens the transmission efficiency curve and avoids high mass stagnation.

In one embodiment, the alternating voltages applied may include a further superimposed component consisting of anti-phase voltages applied to alternate electrodes Thus, the means to apply alternating voltages may also be arranged to apply a second alternating voltage waveform to each electrode simultaneously with the first such that anti-phase alternating voltages are applied to alternate electrodes. A composite waveform is thus applied. The anti-phase voltages generate a series of static Paul traps along the axis of the device. The applied composite waveform thus promotes transmission between Paul traps in the direction of wave propagation. The application of the anti-phase voltages assists in very low pressure regions, as the radial focussing effect is enhanced. The difficulty in such low-pressure regions is that an ion travelling in a direction away from and out of the electric field produced by the electrodes may not collide with another particle until it is too far from the field for the focussing of the field to be effective. Thus fewer particles are actually focussed, unless the focussing effect of the field is enhanced as described. The second alternating voltage waveform may be 1 to 4 MHz in frequency.

The distance between the electrodes may be any suitable distance and preferably there is the same distance between each of the adjacent electrodes. The electrodes may be of any desired shape and may all be identical. Preferably each electrode defines a central aperture, which may be of any desired shape and in one preferred embodiment is circular, and in another preferred embodiment is a slit.

In one embodiment the electrodes or the field applied thereby is conveniently arranged to focus the ions to and to impel them along a straight path through the device. In another embodiment, however, the electrodes or field is arranged to focus the ions to and to impel them along a curved path. In use, when ions are admitted to the device, neutral entities such as gas molecules, droplets of liquid and other matter will also enter the device and these will affect the pressure within the device and hence the frequency of collision of the ions and the effectiveness of focussing and impelling of the ions. More seriously, however, where the device feeds a mass analyser, the neutral matter can pass through the device and interfere with analysis by the analyser. By arranging the electrodes or field to focus the ions to and to impel them along a curved path, the ions will take a different path from the uncharged entities and so the effect of the presence of the admitted neutral entities can be minimised. A non-straight path may also be desirable for spatial arrangement or other reasons. The path may curve in only one direction or may be S-shaped or may curve in more directions. The curved path may have a constant radius or the radius may vary, as desired. Preferably the electrodes are arranged in the curved path. The electrodes may be planar and may lie on planes which are substantially radial to the curve.

According to another aspect of the invention there is provided a method wherein a method of focussing and conveying ions comprising applying at least one alternating voltage waveform to each of a plurality of electrodes in series, the phase of the or a first alternating voltage applied to each electrode in the series being ahead of the phase of the or the first alternating voltage applied to the preceding electrode in the series by less than 180° such that the ions are focussed on to an axis of travel and advanced along the series of electrodes.

The phase-difference between the electrodes may be set at any suitable level, and preferably there is the same phase-difference between each of the adjacent electrodes. The phase-difference is preferably 360°/n where n is a natural number greater than two, and preferably greater than three, as this leads to a smoother transmission of the ions. The waveform of the applied alternating voltage may be of any suitable shape and may be sinusoidal, triangular or square. The alternating voltages applied may include a further superimposed component consisting of anti-phase voltages applied to alternate electrodes.

The voltages may be applied to the electrodes and/or the electrodes may be arranged such that ions are focussed and advanced along a straight, or a curved path.

Embodiments of the invention will now be described by way of example and with reference to the accompanying drawings, in which.

Figure 4A:
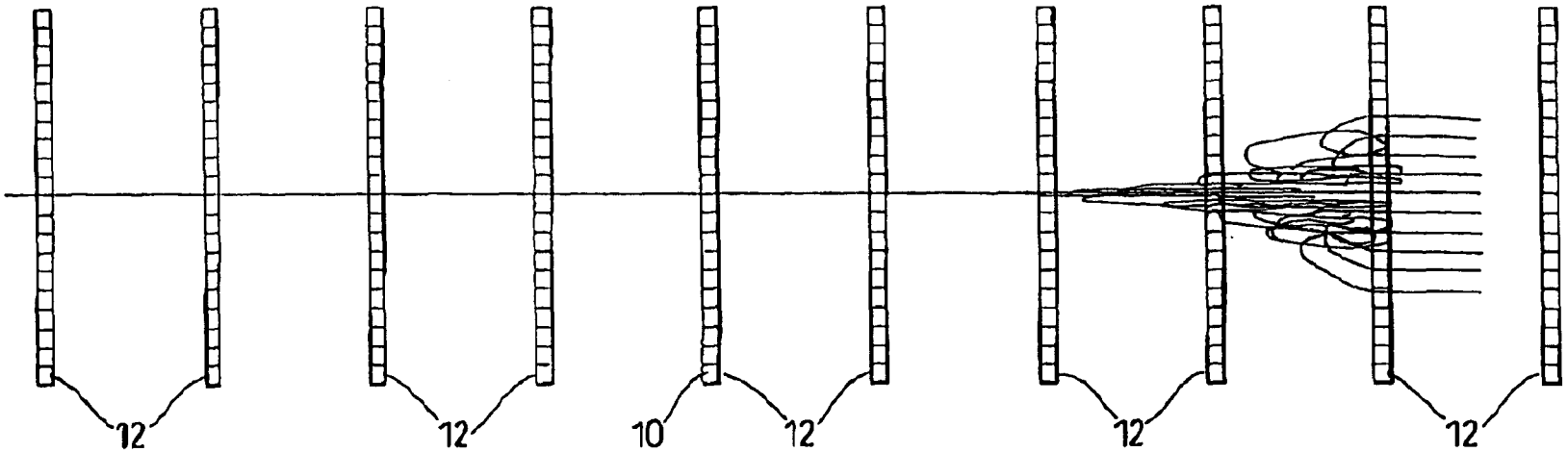
Figure 4B:
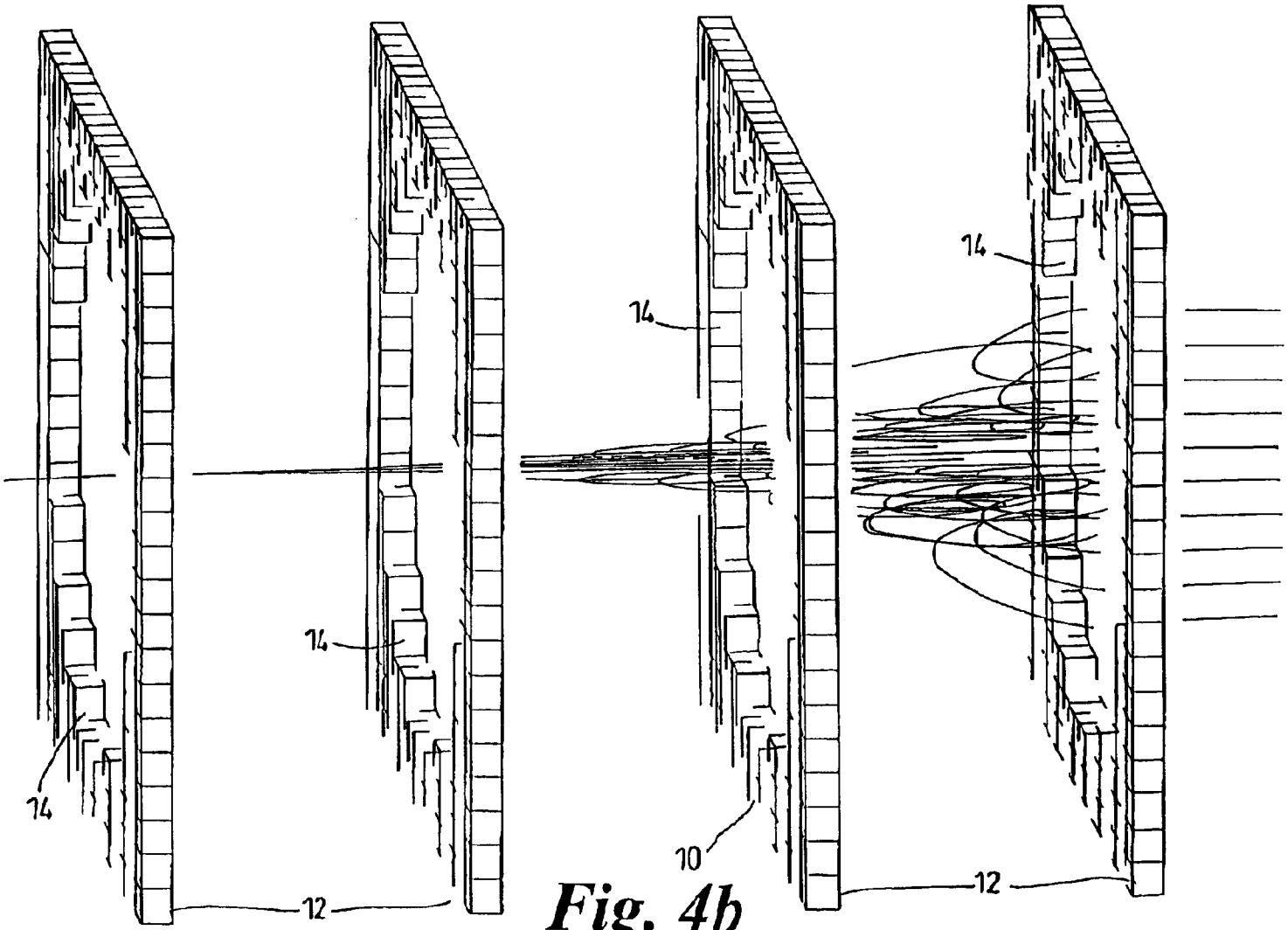

FIG. 4*a* is a plan view of computer modelled ion movement paths in the device of the first embodiment under a first applied voltage condition;

FIG. 4*b* is a detail perspective view of the paths shown in FIG. 4*a;*

Figure 5:
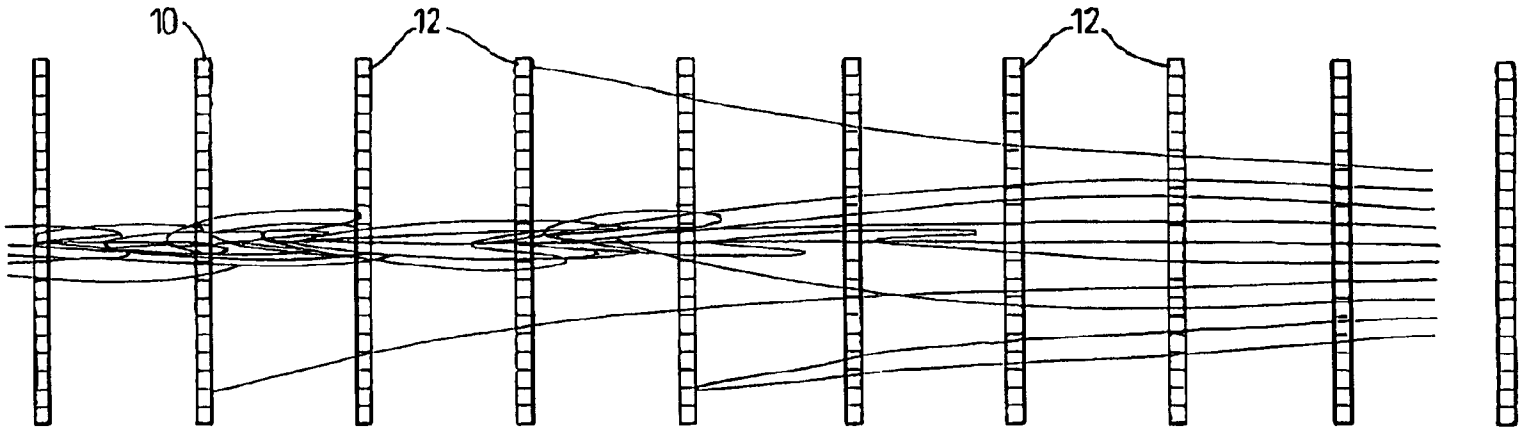

FIG. 5 is a plan view of computer modelled ion movement paths in the device of the first embodiment under lower pressure than in FIGS. 4*a* and 4*b;*

Figure 6A:
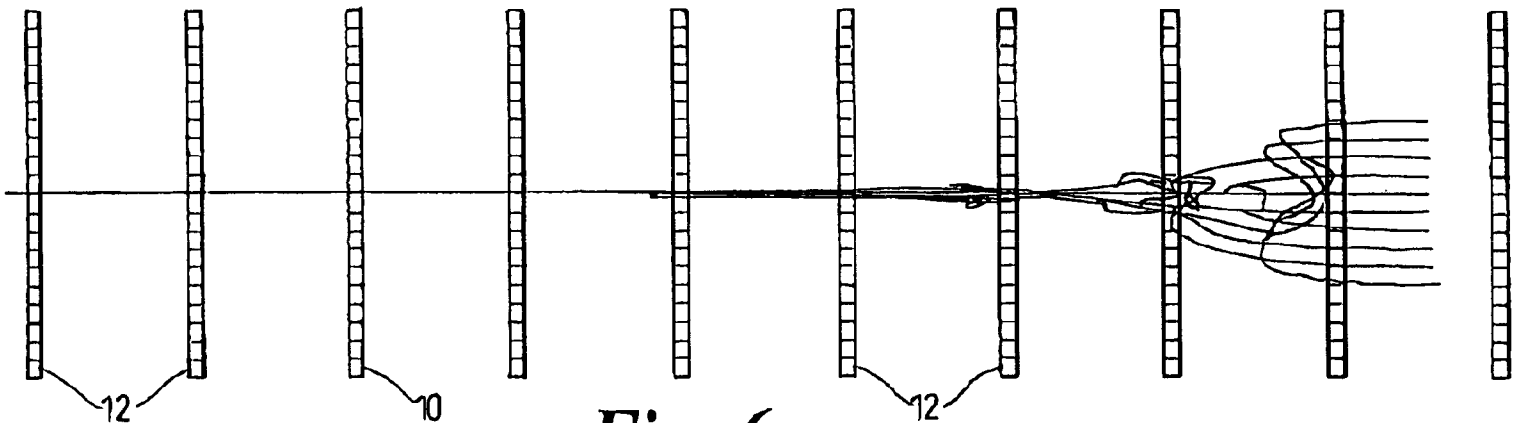
Figure 6B:
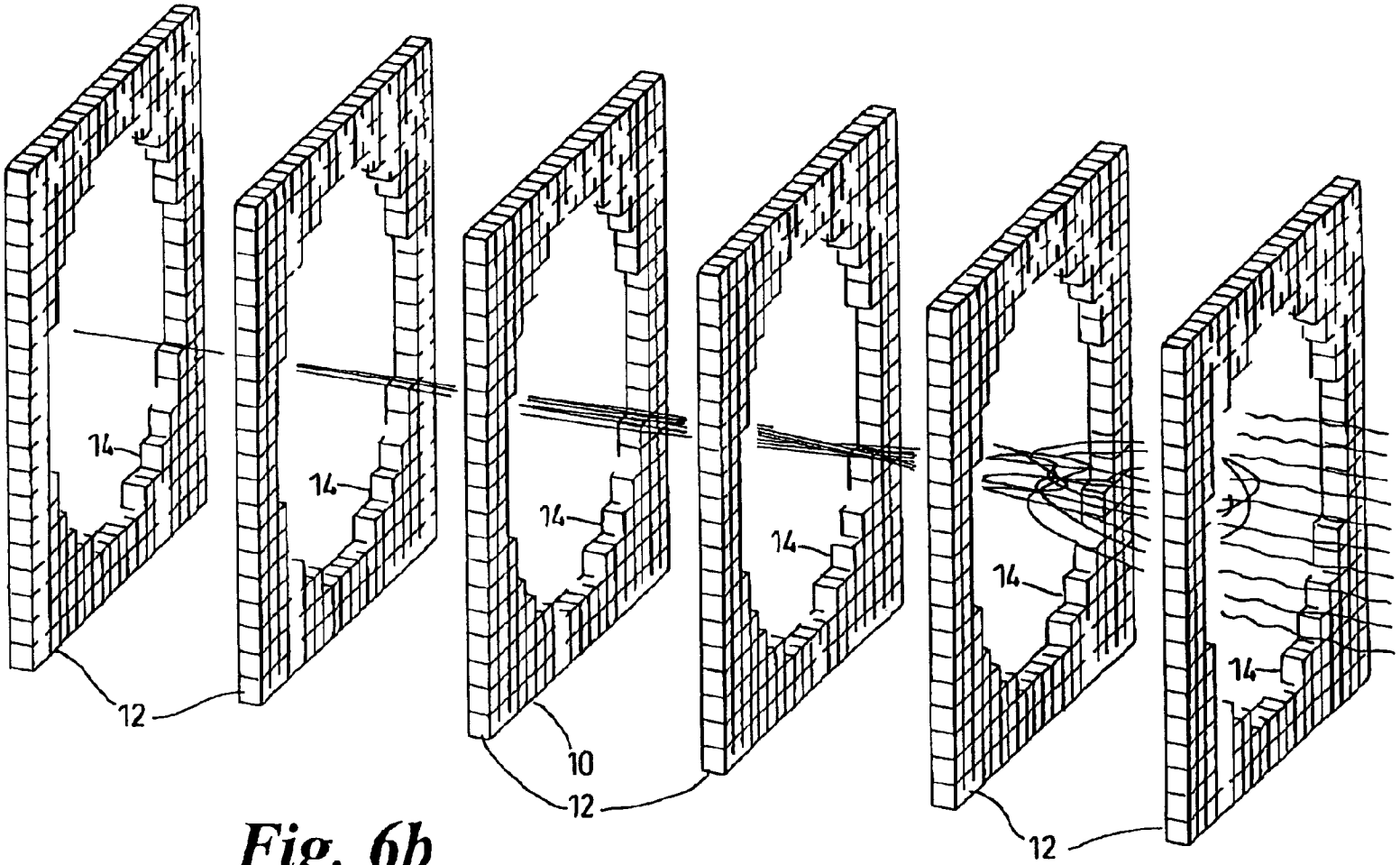
Figure 7:
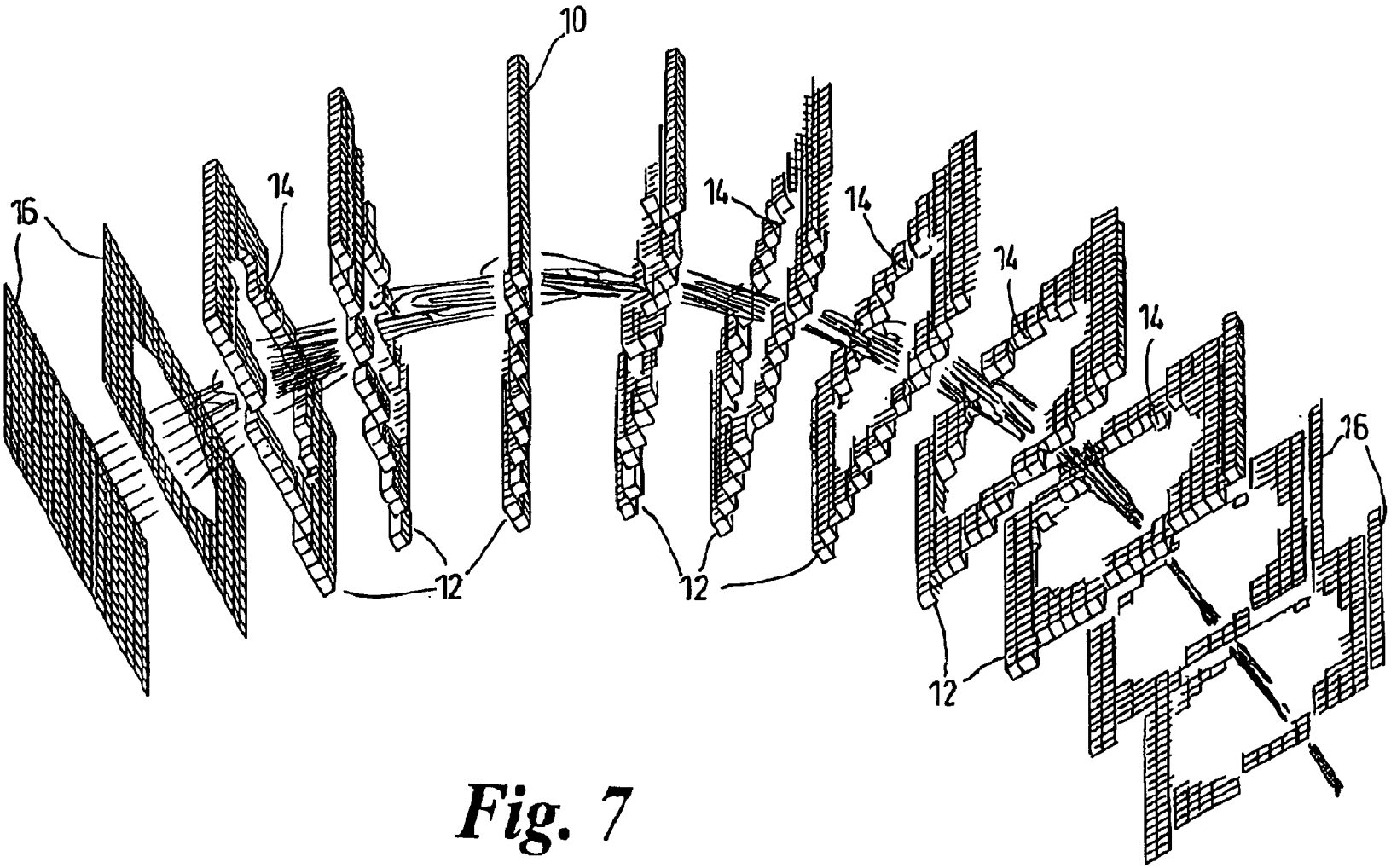

FIG. 6*a* is a plan view of computer modelled ion movement paths in the device of the first embodiment under a second applied voltage condition and the same pressure as in FIG. 5, FIG. 6*b* is a detail perspective view of the paths shown in FIG. 6*a;* and, FIG. 7 is a perspective view of the device of the second embodiment of the invention.

Figure 1:
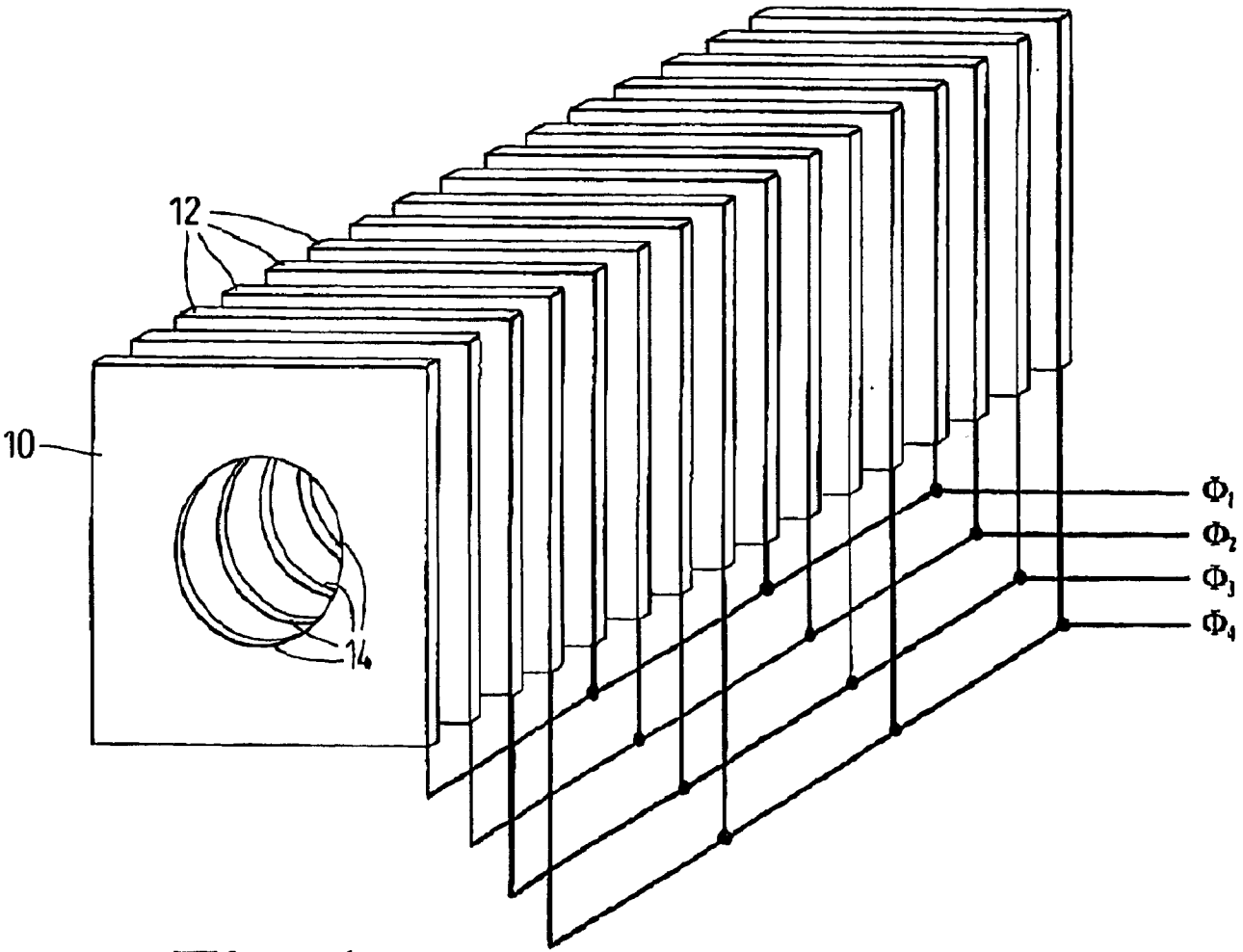
FIG. 1 is a perspective view of the device of the first embodiment of the invention.

The device 10 of the embodiment of the invention comprises, as shown in FIG. 1, a series of square electrode plates 12, each with a circular central aperture 14. The plates 12 are arranged in parallel planes with the centres of the circular apertures 14 aligned along an axis. The cross-section of both the electrode plates 12 and the apertures 14 may take other shapes such as, elliptical, rectangular or indeed any regular or irregular polygon or curve, such shapes being used to define the symmetric or asymmetric performance of the device. The apertures 14 are about 20 mm in diameter and the spacing between adjacent electrode plates 12 is about 10 mm. As shown, every fourth electrode plate 12 is connected to a common alternating voltage source Φ1 to Φ4, the sources differing in phase.

Figure 2:
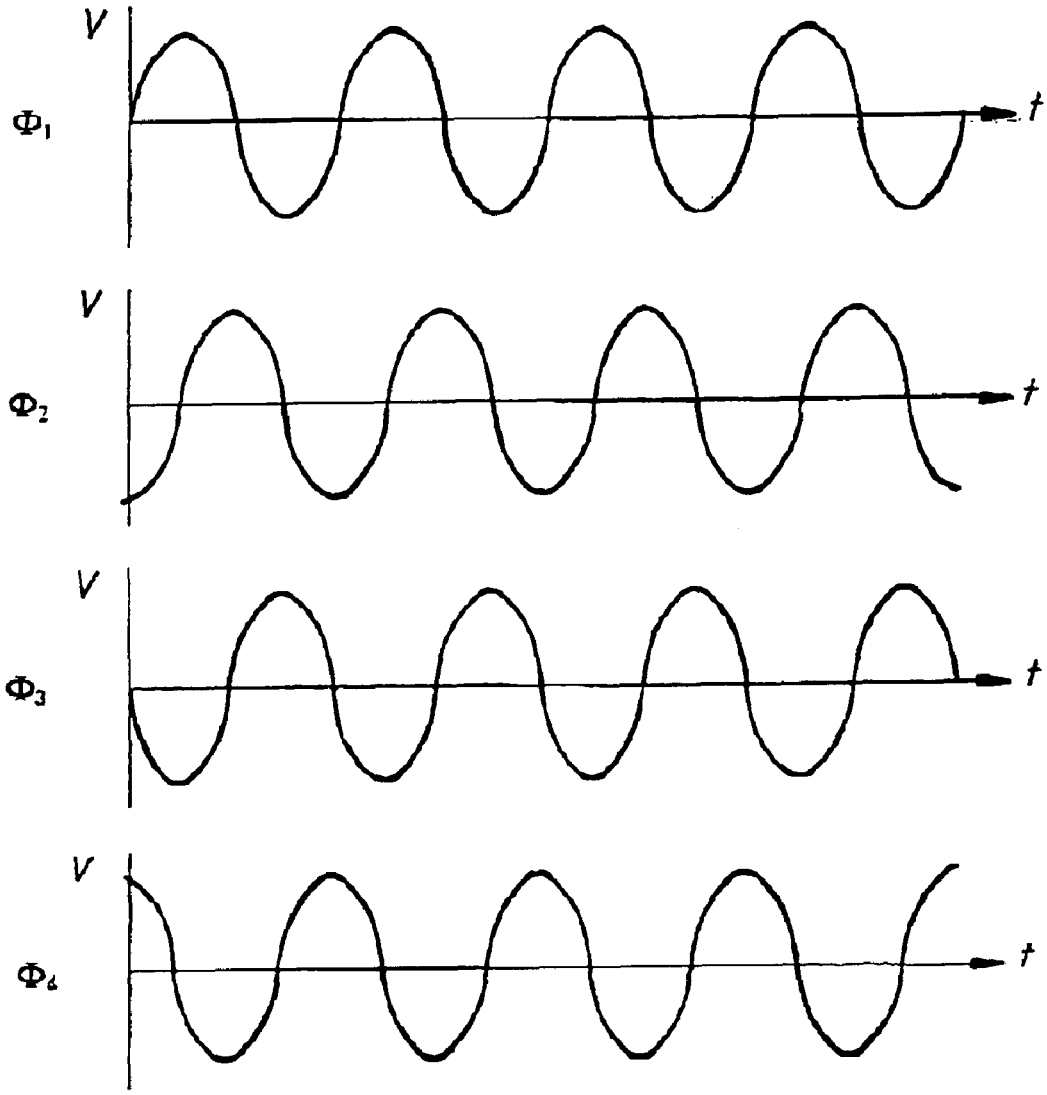
FIG. 2 is four graphs of voltage waveforms having the same time axis, the waveforms representing the phases of the alternating voltages applied to each set of four electrodes in the series shown in FIG. 1.
Figure 3:
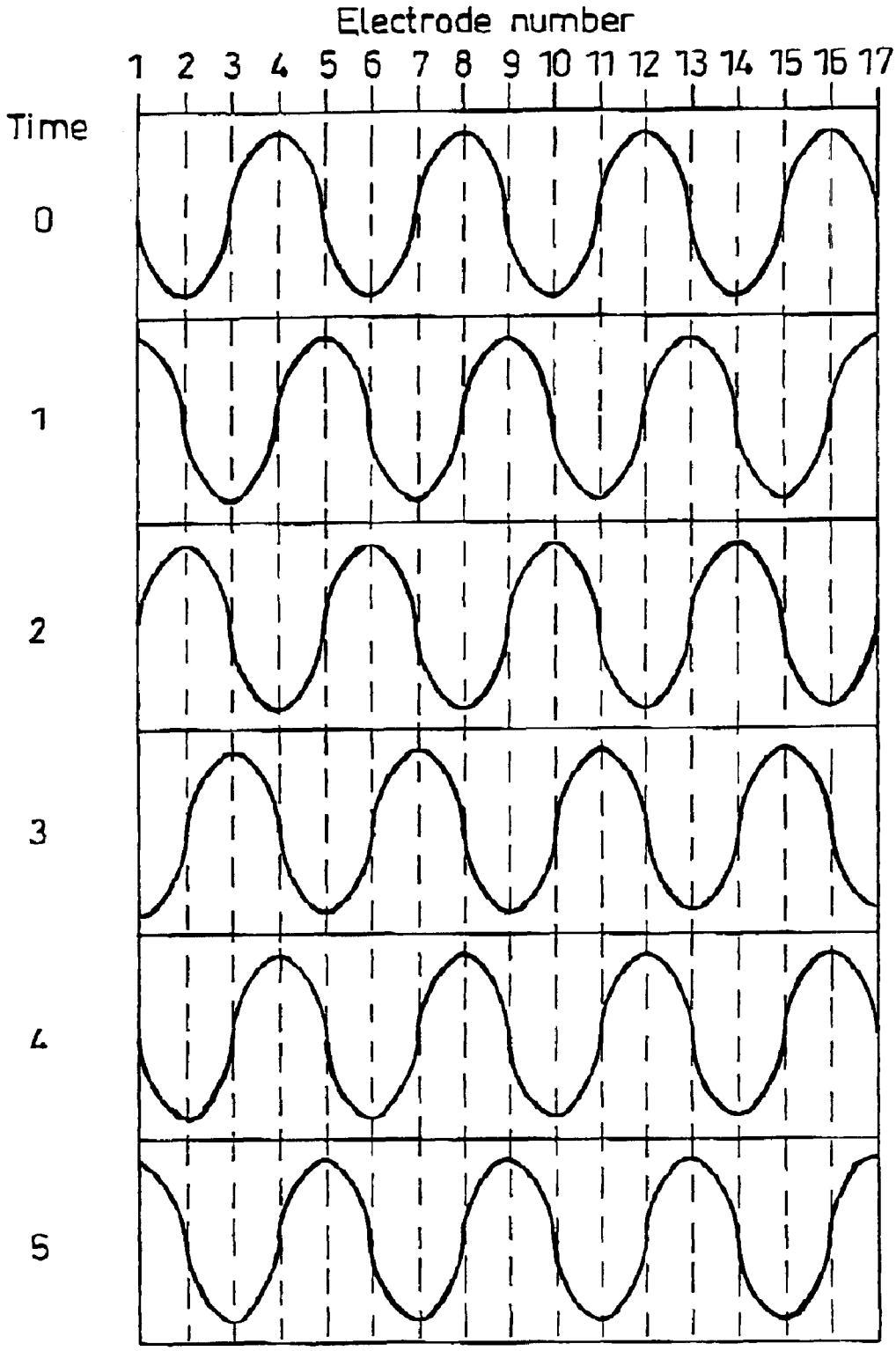
FIG. 3 is a temporal series of graphs of voltage against electrode location in the device of FIG. 1.

FIG. 2 shows an example of a series of suitable voltage waveforms for the sources Φ1 to Φ4, namely, four sinusoids phase shifted 90° with respect To each other. Such suitable waveforms arc hereafter collectively called "conveyor" waveforms. The conveyor waveforms are applied to the electrodes 12 sequentially and repetitively according to the number of phases employed. FIG. 3 shows a series of temporal snapshots of the voltages applied to the series of electrodes 12. The effect of the conveyor waveforms is to produce a travelling wave as a function of time, which is reflected in the electric field produced within the electrode structure. Reversal in order of the conveyor waveforms causes the wave to propagate in the opposite direction. This four-phase sinusoid configuration is the lowest order solution which provides a smooth propagation wave. Equation 1 shows the relationship between the propagation velocity of the wave (v), electrode spacing (l) and frequency of applied conveyor waveforms (f).

$$v-4lf \qquad (I)$$

The action of this travelling wave is to push any charged entity within the electric field in the direction of propagation of the wave, providing motive force for transmission through the device 10. The trapping and focusing action of this device comes from the "Paul" effect in which two anti-phase radio-frequency (RF) voltages are applied to alternate electrodes in the structure to produce an alternating field with a field-free region at its centre. This effect produces radial focusing of the charged entities at the centre of the electrodes trapping them in a series of field-free regions along the central axis of the device. The conveyor waveforms utilised here form two pairs of anti-phase voltages producing a series of inter-linked Paul traps which propagate axially along the device.

FIGS. 4*a* and 4*b* show a Simion 6 ion trajectory simulation for the device 10 utilising the illustrated conveyor waveforms, where FIG. 4*a* is a 2-dimensional plot of ion trajectories and 4*b* is a close-up 3-dimensional plot of the focusing region. A voltage of 3 kV was applied at an alternating frequency of 500 kHz. Ten trajectories for an ion of mass 1000 amu with energy 200 eV are plotted from a series of positions across the aperture of the device with a short mean free path set to simulate medium to high pressure regions. Prompt radial focusing occurs as the ions describe orbits in the alternating electric field with the orbital motion collapsing into an oscillatory motion along the central axis of the device 10. As the ions reach the central axis the propagation wave dominates their motion pushing them through the device 10.

FIG. 5 shows a Simion 6 ion trajectory simulation where the mean free path has been increased by an order of magnitude to simulate low pressure regions. At low pressures where the mean free path is large and energy loss due to collisions is small the efficiency of radial focusing and trapping decreases. This is because the velocity of the charged entity carries it away from the influence of a given electrode 12 before it has experienced the influence of a fill cycle of the alternating electric field, necessary for effective trapping. Increasing the frequency of the conveyor waveforms to increase trapping efficiency results in a proportionate increase in wave propagation velocity leading to increased velocity of the charged entities. The net result is little improvement in trapping efficiency and increased energy spread.

It is possible to modify the conveyor waveforms applied to the electrodes 12 to restore good performance in low pressure regions. By applying anti-phase RF voltages at, say, 2 MHz, to alternate electrodes 12 a series of static Paul traps is generated along the axis of the device. The conveyor waveforms can be superimposed on the RF voltages to produce four "composite" waveforms. The superimposed conveyor waveform, promotes transmission between Paul traps in the direction of wave propagation. FIGS. 6*a* and 6*b* show Simion 6 ion trajectory simulations for the device 10 utilising the composite waveforms, where FIG. 6*a* is a 2-dimensional plot of ion trajectories and FIG. 6*b* is a close-up 3-dimensional plot of the focusing region. The simulation parameters are the same as for FIG. 5 (i.e. the same low pressure) except for the application of composite waveforms.

Both variations, namely the conveyor and composite waveforms, show good radial focusing properties. Transmission efficiency is good over a large mass range but is related to the conveyor frequency, higher masses take longer to propagate through the device 10 for a given conveyor frequency. For very large mass ranges the conveyor frequency may be swept in order to flatten the transmission efficiency curve and avoid high mass stagnation.

The device or multiple devices can thus be interposed between an electrospray needle and a mass analyser, for example, in place of the first and second apertures described (which can be defined by a capillary tube and a conical skimmer) and will allow a very high proportion of the ions produced to be focussed for use rather than lost as in the known technique described.

The device is in no way limited to use with ESI sources and could be used with MALDI (Matrix Assisted Laser Desorption/Ionisation) sources, atmospheric MALDI sources, chemical ionisation sources or any other suitable ion source.

The device can be used with any suitable kind of mass spectrometer such as a Fourier Transform Ion Cyclotron Resonance (FTICR) spectrometer, quadrupole spectrometer ion trap spectrometer or orthogonal time-of-flight spectrometer, for example. The device can be used for RF ion traps in which pressure within the mass analyser is high due to the presence of buffer gas.

Combinations of the device utilising both conveyor and composite waveforms may be used to control the transmission of charged entities from high pressure regions through to low pressure regions and if required back to high pressure regions and to control their kinetic energies. Use of this device as a collision cell or modification of a multipole by division of the multipole into discrete electrodes and application of the conveyor waveforms to assist transmission are examples of application.

The two basic elements, being the conveyor and the Paul trap waveforms, represent extremes, between which lie a continuous range of different operating devices.

The device 10 of the second embodiment as shown in FIG. 7 is similar to that of the first and only the differences from the first embodiment will be described. The same reference numerals will be used for equivalent features.

In the second embodiment, the electrodes 12 are the same as in the first embodiment but instead of being arranged with the centres of the apertures 14 in a straight line, they are arranged in a smooth curve of constant radius. The radius at the centre line or so-called "optical axis" is 60 mm. The electrode plates 12 are arranged at 10° intervals and eight are shown, so that the ion path is curved through 80°. There are two charged sheets 16 at each end of the device 10 and there is no curvature of the path between the sheets 16 at each end. As mentioned, the ion path within the device 10 is kept at a controlled low pressure. When ions are admitted to the device 10 gas or other molecules are drawn in by the vacuum together with other neutral entities. In the case where the device 10 is used with an ESI source, droplets of solvent may enter the device 10. These uncharged entities will not be affected by the applied electric field in the same way as the ions and so will tend to continue to travel through the device 10 in a straight path. In the device 10 of the first embodiment, this will take them along the ion path, which is undesirable, in particular where the device 10 feeds into a mass analyser into which the uncharged entities may pass with the focussed ions. In the device 10 of the second embodiment, the ion path is curved and so the ions are diverted away from the likely path of the uncharged entities and so interference with the desired pressure is minimised. It is seen that focussing does not take place as quickly as in the device 10 of the first embodiment but this can be compensated for by adding more electrode plates 12 or by adding electrodes 12 on a straight path at the end of the curve.

Two effects are seen. One is that the ions arc curved away from a straight path by the electric field from the electrodes 12. The other is that the electrodes themselves deflect the neutral entities away from the path taken by the ions. The straight path, as shown at 18, taken by the neutral entities will hit an electrode 12 along the ion path which is at an angle to the straight path such that it will deflect the incident entities.

What is claimed is:

1. An ion focussing and conveying device comprising a plurality of electrodes in series, and means to apply at least one alternating voltage waveform to each electrode, the phase of the alternating voltage in said at least one alternating voltage waveform applied to each electrode in the series being ahead of the phase of the or the first alternating voltage waveform applied to the preceding electrode in the series by less than 180° such that ions are focussed onto an axis of travel and impelled along the series of electrodes, wherein there is a common phase-difference between all adjacent electrodes which is 360°/n, where n is a natural number greater than two.

2. A device as claimed in claim 1, wherein the common phase-difference is 360°/n, where n is a natural number greater than three.

3. A device as claimed in claim 1, wherein the means to apply at least one alternating voltage waveform applies an alternating voltage with a sinusoidal waveform to each electrode.

4. A device as claimed in claim 1, wherein the means to apply at least one alternating voltage waveform applies an alternating voltage with a triangular waveform to each electrode.

5. A device as claimed in claim 1, wherein the means to apply at least one alternating voltage waveform applies an alternating voltage with a square waveform to each electrode.

6. A device as claimed in claim 1, wherein the frequency of said at least one applied alternating voltage waveform is less than 100 kHz.

7. A device as claimed in claim 1, wherein the frequency of said at least one applied alternating voltage waveform is altered in use.

8. A device as claimed in claim 7, wherein the frequency of said at least one applied alternating voltage waveform is swept.

9. A device as claimed in claim 8, wherein the frequency of said at least one alternating voltage waveform is swept over a range of at least 100 kHz.

10. A device as claimed in claim 1, wherein means is provided to apply a second alternating voltage waveform to each electrode simultaneously with the first such that anti-phase alternating voltages are applied to alternate electrodes.

11. A device as claimed in claim 10, wherein the second alternating voltage waveform is between 1 and 4 MHz in frequency.

12. A device as claimed in claim 1, wherein there is the same distance between each of the adjacent electrodes.

13. A device as claimed in claim 1, wherein the electrodes are all identical.

14. A device as claimed in claim 1, wherein each electrode defines a central aperture.

15. A device as claimed in claim 14, wherein the aperture is circular.

16. A device as claimed in claim 14, wherein the aperture is a slit.

17. A device as claimed in claim 1, wherein the plurality of electrodes or field is arranged to focus the ions to and impel them along a curved path.

18. A device as claimed in claim 17, wherein the path curves in only one direction.

19. A device as claimed in claim 18, wherein the curved path has a constant radius.

20. A device as claimed in claim 17, wherein the electrodes are arranged in the curved path.

21. A device as claimed in claim 17, wherein the electrodes are planar and lie on planes which are substantially radial to the curve.

22. Apparatus consisting of an ion source supplying ions directly into a device according to claim 1, which in turn supplies ions directly into a mass analyser.

23. Apparatus as claimed in claim 22, wherein the ion source is an electrospray ionisation needle.

24. A method of focussing and conveying ions comprising applying at least one alternating voltage waveform to each of a plurality of electrodes in series, the phase of said at least one alternating voltage applied to each electrode in the series being ahead of the phase of said at least one alternating voltage applied to the preceding electrode in the series by less than 180° such that the ions are focussed on to an axis of travel and advanced along the series of electrodes, wherein there is a common phase-difference between all adjacent electrodes which is 360°/n, where n is a natural number greater than two.

25. A method as claimed in claim 24, wherein there is the same phase-difference between all adjacent electrodes.

26. A method as claimed in claim 25, wherein the phase-difference is 360°/n, where n is a natural number greater than three.

27. A method as claimed in claim 24, wherein the waveform of said at least one applied alternating voltage is sinusoidal.

28. A method as claimed in claim 24, wherein the waveform of said at least one applied alternating voltage is triangular.

29. A method as claimed in claim 24, wherein the waveform of said at least one applied alternating voltage is square.

30. A method as claimed in claim 24, wherein the frequency of said at least one applied voltage is less than 100 kHz.

31. A method as claimed in claim 24, wherein the frequency of said at least one applied voltage is altered.

32. A method as claimed in claim 31, wherein the frequency of said at least one applied voltage is swept.

33. A method as claimed in claim 32, wherein the frequency of said at least one applied voltage is swept over a range of at least 100 kHz.

34. A method as claimed in claim 24, wherein a second alternating voltage waveform is applied to each electrode simultaneously with the first such that anti-phase alternating voltages are applied to alternate electrodes.

35. A method as claimed in claim 34, wherein the second alternating voltage waveform is between 1 and 4 MHz in frequency.

36. A method as claimed in claim 24, wherein the voltages are applied to the electrodes and/or the electrodes are arranged such that ions are focussed and advanced along a curved path.

37. A method as claimed in claim 36, wherein the path curves in only one direction.

38. A method as claimed in claim 37, wherein the curved path has a constant radius.

39. An ion focussing device comprising a plurality of electrodes in series, and means to apply at least one alternating voltage waveform to each electrode, the phase of the alternating voltage in said at least one alternating voltage waveform applied to each electrode in the series and the phase of said at least one alternating voltage waveform applied to the preceding electrode in the series being such that ions are focussed onto an axis of travel, each electrode defining a single aperture on the axis, the apertures being identical.

40. A device as claimed in claim 39, wherein there is the same distance between each of the adjacent electrodes.

41. A device as claimed in claim 40, wherein each electrode defines a central aperture.

42. A device as claimed in claim 41, wherein the aperture is circular.

43. An ion focussing and conveying device comprising a plurality of electrodes in series, and means to apply at least one alternating voltage waveform to each electrode, the phase of the alternating voltage in said at least one alternating voltage waveform applied to each electrode in the series being ahead of the phase of said at least one alternating voltage waveform applied to the preceding electrode in the series by less than 180° such that ions are focussed onto an axis of travel and impelled along the series of electrodes, said electrodes being planar and arranged in a curved path and lying on planes which are substantially radial to the curved path wherein said electrodes are arranged to focus the ions to and impel them along said curved path.

44. A device as claimed in claim 43, wherein the path curves in only one direction.

45. A device as claimed in claim 44, wherein the curved path has a constant radius.

46. A method of focussing and conveying ions comprising applying at least one alternating voltage waveform to each of a plurality of electrodes in series, the phase of said at least one alternating voltage applied to each electrode in the series and the phase of said at least one alternating voltage waveform applied to the preceding electrode in the series being such that ions are focussed onto an axis of travel, each electrode defining a single aperture on the axis, the apertures being identical.

47. A method of focussing and conveying ions comprising applying at least one alternating voltage waveform to each of a plurality of electrodes in series, the phase of the alternating voltage in said at least one alternating voltage waveform applied to each electrode in the series being ahead of the phase of said at least one alternating voltage waveform applied to the preceding electrode in the series by less than 180° such that ions are focussed onto an axis of travel and impelled along the series of electrodes, said electrodes being planar and arranged in a curved path and lying on planes which are substantially radial to the curved path wherein said electrodes are arranged to focus the ions to and impel them along said curved path.

48. A method as claimed in claim 47, wherein the path curves in only one direction.

49. A method as claimed in claim 48, wherein the curved path has a constant radius.

* * * * *